US006530552B2

(12) United States Patent
Bergaretxe

(10) Patent No.: US 6,530,552 B2
(45) Date of Patent: Mar. 11, 2003

(54) CURVED FORMWORK SYSTEM WITH VARYING CURVATURE

(75) Inventor: Alberto Arozena Bergaretxe, Oñate (ES)

(73) Assignee: ULMA C Y E, S. COOP., Onate (ES)

( * ) Notice: Subject to any disclaimer, the term of this patent is extended or adjusted under 35 U.S.C. 154(b) by 0 days.

(21) Appl. No.: 10/153,491

(22) Filed: May 16, 2002

(65) Prior Publication Data

US 2002/0139917 A1 Oct. 3, 2002

Related U.S. Application Data

(63) Continuation of application No. PCT/ES00/00350, filed on Sep. 18, 2000.

(51) Int. Cl.[7] ..... E01C 7/00

(52) U.S. Cl. ..... 249/4; 249/219.2; 249/18; 249/194; 249/155

(58) Field of Search ..... 249/1, 4, 10, 18, 249/40, 154, 155, 189, 210, 194, 219.1, 219.2, 44, 47

(56) References Cited

FOREIGN PATENT DOCUMENTS

| | | |
|---|---|---|
| EP | 0 514 712 | 2/1996 |
| EP | 0 799 950 | 10/1997 |
| ES | 2 141 010 | 3/2000 |
| FR | 2 698 648 | 6/1994 |
| FR | 2 711 705 | 5/1995 |

*Primary Examiner*—Carl D. Friedman
*Assistant Examiner*—Naoko Slack

(57) ABSTRACT

The formwork system is based on the use of modules that can be coupled to each other, both laterally and vertically, with each one comprised of a pair of metal sheets (2) that determine the inner and outer faces of the formwork, with threaded transverse rods (25) that join the sheets (2) to each other, and welded to the outer sides of these are a series of trapezoidal profiles (7) and two edge profiles (7'). The system includes stiffeners (10) that are provided with tensioning devices, with the stiffeners (10) connected to the trapezoidal profiles (7) by triangular plates (13) on which act the tensioning devices in order to move these triangular plates and thereby to curve the panel, maintaining the curvature in the blocked position by means of a device installed between the triangular plate (13) and the corresponding trapezoidal profile (7) and by another tensioning device (12) applied to the stiffeners (10).

7 Claims, 5 Drawing Sheets

CURVED FORMWORK SYSTEM WITH VARYING CURVATURE

This application is a continuation of International Application Number PCT/ES00/00350 filed Sep. 18, 2000.

OBJECT OF THE INVENTION

The present invention relates to a curved formwork system with varying curvature, the purpose of which is to enable the construction of curved walls in building and civil work, having characteristics that solve the need for a versatile and functional formwork.

The formwork that is the object of the invention allows a great simplicity in its assembly and curvature, involving minimal labor expenditure.

The special characteristics of the system provide the formwork with great sturdiness that allows numerous re-usages with configurations differing in radius and height.

BACKGROUND OF THE INVENTION

Many modular curved formwork types are known that are used by the applicant firm and by many others, such as PERI, DOKA, HÜNNEBECK, MEVA, MECANOTUBO, ALSINA, PASCHAL, etc., such that the formworks used by many of these companies comprise a face sheet on which a fixed number of girders are attached in the form of vertical ribs, so that on said girders or vertical ribs are placed more-or-less ingenious systems of tensioning devices and stiffeners in order to curve the formwork panel and support the concrete pressure respectively.

As regards the lateral union of the formwork panels, each brand or manufacturer uses its own profile or attachment system, whether it be a clip, lock or the like.

Among specific systems used to make circular formworks can be cited those described in Spanish Patents 534.744 and 2000777, wherein the former describes a formwork system for curved surfaces with two formwork faces or liner elements conveniently separated to form the mold, complemented by trapezoidal profiles attached to the external face of said elements, jointed to which profiles are attachment elements or parts that are joined to each other by tensioning devices comprised of a bushing which screw onto two segments with opposite threads and are joined to the ends of the aforementioned parts attached to the trapezoidal profiles, so that turning these bushings in one sense or the other results in pulling on or separating the consecutive trapezoidal profiles, and thereby the curvature of the elements that make up the formwork face or liner.

In the second patent cited, No. 2000777, another formwork is described for circular or polygonal constructions in which exists a series of segments related to each other by their ends, forming beams that are placed outside of the elements that make up the formwork face or liner, with tensioning devices provided between each two beam segments that when actuated perform the same function as in the previous case, that is, separating or approximating the segments of beams, which as they are attached to the formwork faces or liners cause the curvature or angle between segments.

In addition may be mentioned European Patent 0 514 712, which describes a formwork for surfaces with differing curvature based on the same principles as the previous one, in which the elements that are mounted on the trapezoidal profiles instead of being individually attached to said profiles have the special characteristic that each element defines a stiffener mounted between two trapezoidal profiles, further forming a support for a bar that joins to each other the two faces that form the formwork.

In this European Patent, said stiffeners incorporate on one of their ends an adjustment spindle that is related to a shaft or pin, and by a suitable part it is hinged to the trapezoidal profile, with actuation of said spindle causing the separation or approximation of the two parts that connect the stiffener to the two consecutive trapezoidal profiles, and therefore giving them a tendency to approach or separate from each other, thus producing the curvature of the corresponding formwork face or liner.

The two stiffeners of each strap are joined by intermediate adjustable tensioning devices that are used to adjust uniformly the curvature of the panel in the central zone. Additionally, the panel curvature is completed by end tensioning devices that adjust the roundness of the edges of the formwork panel.

The main drawback of the formwork described in said European Patent is that a large number of elements must be acted upon to curve the panel, firstly the stiffener spindles must be adjusted, then the intermediate tensioning devices and finally the end tensioning devices, thus requiring a large amount of time and/or labor to adjust the curvature of the entire formwork.

A further disadvantage is that the curved formwork system of this patent uses different stiffener-spindle-nut assemblies depending on whether it is used for the inner side of the curvature or the outer side, thus complicating the assembly of the formwork.

DESCRIPTION OF THE INVENTION

The formwork system herein disclosed, being based on those cited in the previous section, presents a number of special characteristics or improvements that provide new functions, improved results and optimized functionality and usefulness of the formwork itself.

More specifically, one of the improvements object of the invention is that the formwork face or liner is comprised of a metal sheet on the outer side of which are welded five vertical trapezoidal profiles, and on each end of the sheet is an edge profile, with the stiffeners and the trapezoidal and edge profiles joined by intermediate swiveling elements that can move and turn with respect to the stiffeners. Each swiveling support is comprised of a pair of triangular plates, hereinafter referred to as the triangle, with central and end triangles determined depending on their position.

The central triangles are joined by two of their vertices to two consecutive trapezoidal profiles, while the third vertex is joined to one of the ends of a stiffener, so that one of the unions to the trapezoidal profiles is hinged and the other is such that it can slide somewhat, thereby allowing the triangle to both turn and slide with respect to the stiffener.

The end triangles are joined by one of their vertices to a trapezoidal profile and by another vertex to the edge profile provided on the end of the sheet, with a hinged union at the edge profile and a sliding union at the trapezoidal profile.

In addition, each stiffener is joined to two consecutive triangles, hinged to one and joined to the other so that it can slide, by means of a tensioning mechanism whose operation will be described below.

Thus, mounted on each stiffener is a tensioning mechanism comprised of a spindle and a moving nut, joined to a transverse shaft that is connected to the two plates that form the corresponding triangle, with the spindle's motion limited on one side by the spindle head and on the other by a nut attached to the other end, which elements stop against corresponding plates welded to the stiffener, so that when the outer spindle head is acted upon the moving nut will slide on it, carrying the transverse shaft and thus the triangle to cause said triangle to swivel with respect to the stiffener, while the latter pulls or pushes on the trapezoidal profiles to curve the formwork face.

In accordance with the present invention, the plate that defines a panel incorporates five vertical trapezoidal profiles, two edge profiles, two central triangle joined to the trapezoidal profiles and to one edge profiles, and two stiffeners, each of which is attached to two consecutive triangles.

With this structure it is possible to adjust the curvature of each panel by acting on the tensioning spindles of the stiffeners, which curves the entire panel, including its end and central areas, without requiring special tensioning devices or elements.

Additionally, as there are more profiles that usual and as the stiffeners act on these through swiveling triangles, a greater curvature of the panel is obtained and the formwork face is made rounder.

The system also includes a blocking mechanism that immobilizes the formwork after the desired curvature is obtained, which blocking device or mechanism consists of a threaded stud which, using two lock nuts and being fixed between the triangular plate and the trapezoidal profile, fixes and locks the panel in the curved position given to it.

In addition, between the contiguous ends of the two stiffeners of each strap is provided a central tensioning device that locks the curve in this area.

A further advantage of the system disclosed is that the stiffeners, triangles and tensioning devices used to curve the panel are the same for the inner and outer faces of the panel.

The edge profiles provided on the ends of the metal sheets that form the formwork faces also allow the collateral union of two adjacent panels by special clips provided for this purpose.

Another improvement is that the element that forms the face, that is, the metal sheet, is provided on its top and bottom edges with centering shims that are also provided on the edge profiles, allowing a vertical assembly without any problems, easily and simply.

A further improvement is that said metal sheet that forms the panel liner is provided with lower leveling legs embodied as spindles with a support base, allowing a correct setting and leveling on the floor and prevents the sheet from touching said floor.

DESCRIPTION OF THE DRAWINGS

As a complement of the description being made and in order to aid a better understanding of the characteristics of the invention, according to a preferred embodiment, a set of drawings is accompanied as an integral part of the description where, for purposes of illustration and in a non-limiting manner the following is shown.

PREFERRED EMBODIMENT OF THE INVENTION

Figure 1:
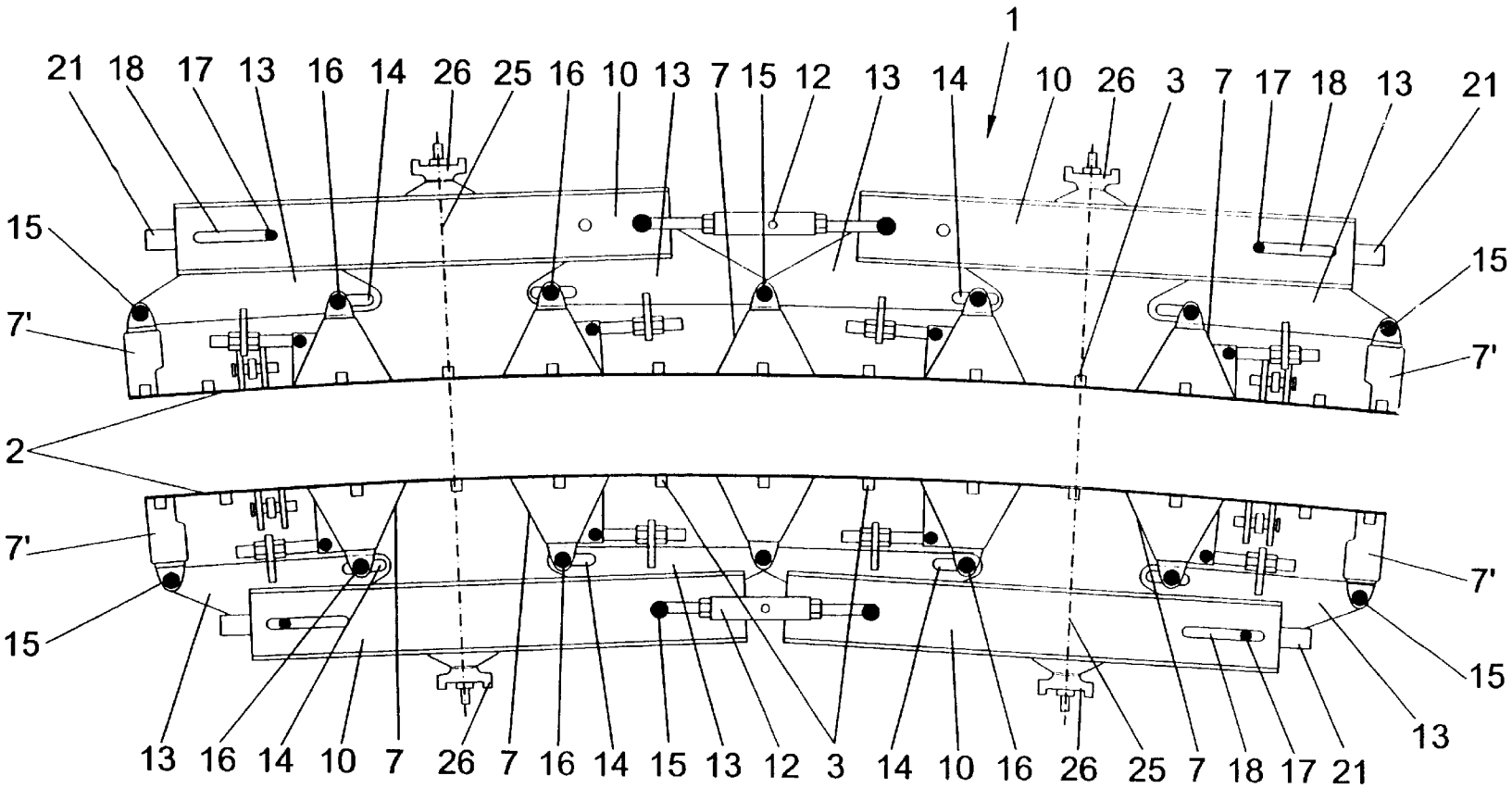
FIG. 1 shows a plan view of a formwork module comprised of two panels opposite each other and made in accordance with the object of the present invention.
Figure 2:
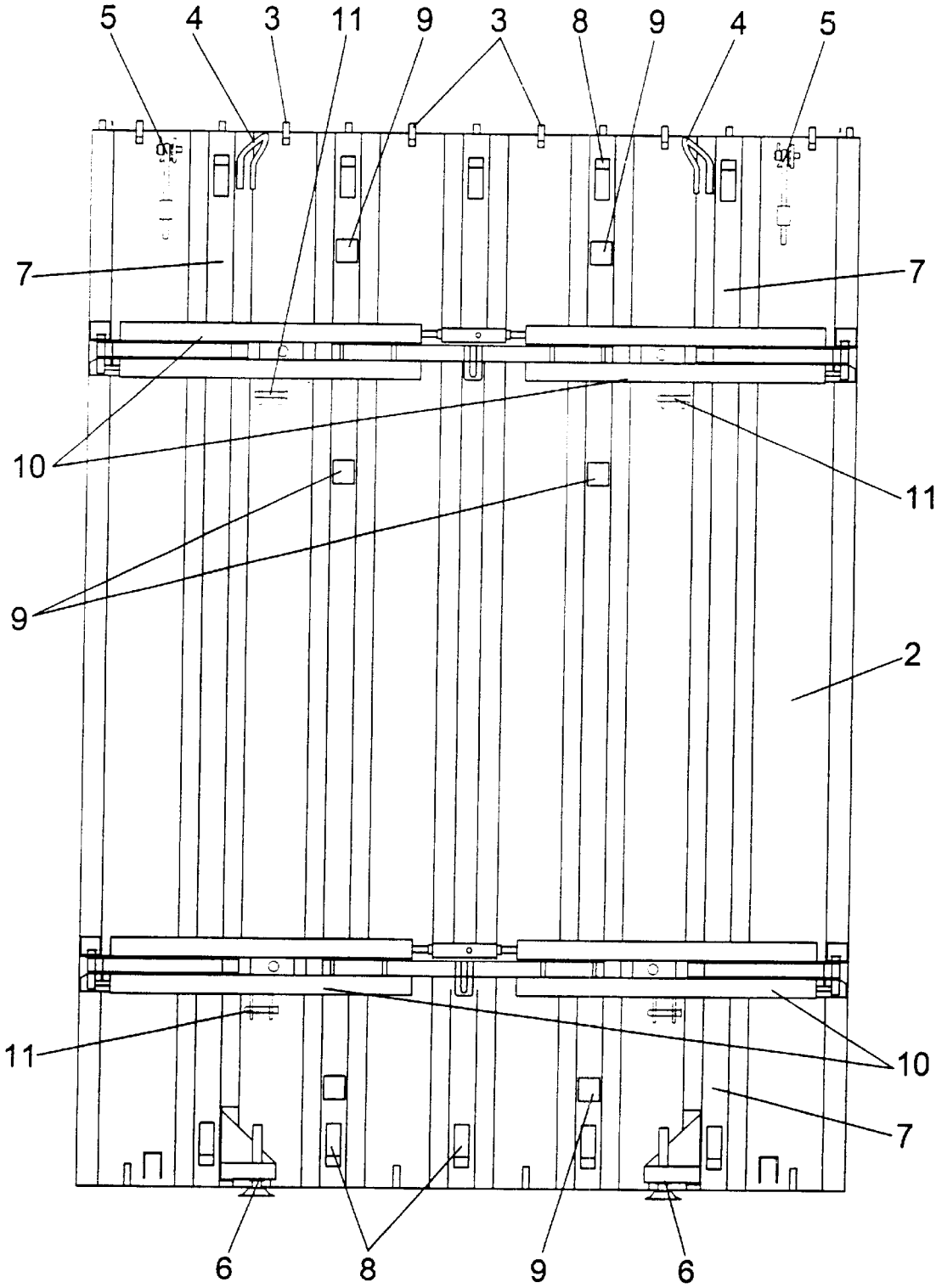
FIG. 2 shows a side view of a vertical arrangement of the module shown in the previous figure.
Figure 3:
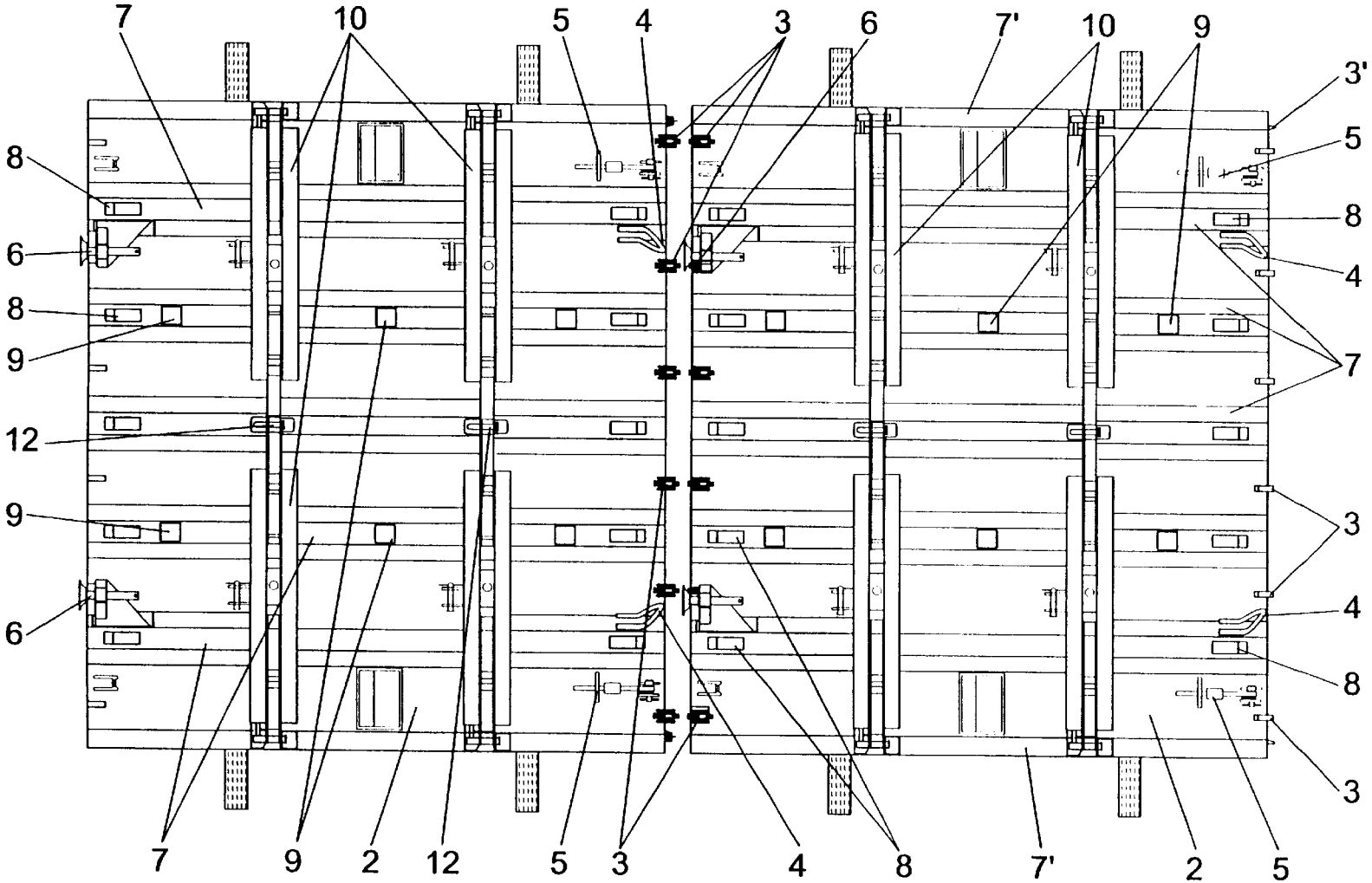
FIG. 3 shows a view of two formwork panels made in accordance with the object of the invention, joined to each other vertically.

As can be seen in the figures, the formwork module labeled in general with the number (1) in FIG. 1 and constructed in accordance with the object of the invention comprises two metal sheets (2), preferably made of special steel with a high elastic limit that allows a curvature up to a minimum inner diameter of two meters, provided both on the top and bottom with centering shims (3) that allow vertical assembly between the panels (1), as well as collateral assembly, as shown in FIG. 3. Additionally, each panel (2) is provided on its top with two hoisting rings (4) and two ties-nuts (5) that secure the vertical attachment of the panels.

On the bottom it includes levelers (6) comprised of a spindle mounted on a nut, joined to the corresponding panel or sheet that it is formed by, and ending in a support base.

On the sides of each formwork sheet (2) is an edge profile (7') that complements the trapezoidal profiles (7) with which each sheet (2) is provided on its external face and vertically, as is shown clearly in FIG. 3. These edge profiles (7') ensure the lateral union of the panels by a clip, with said edge profiles (7') having centering shims (3') that serve the same function as the aforementioned shims (3).

There are five trapezoidal profiles (7) provided on each metal formwork sheet (2), with a high inertia being one of their main characteristics; said profiles (7) have a metal lid on the top and bottom to prevent the concrete from falling out, such that on both their top and bottom they are provided with openings (8) that allow the assembly at a height of the panels (1), while welded at two different heights are the parts used to join the remaining elements to form the straps.

Both the hoisting rings (4) and the levelers (6) are welded onto two of said trapezoidal profiles (7), as is clearly shown in FIGS. 1 and 3.

Two of said trapezoidal profiles (7) are also provided with holds (9) to which are fixed the working overhangs used to form the concreting platform.

Figure 4:
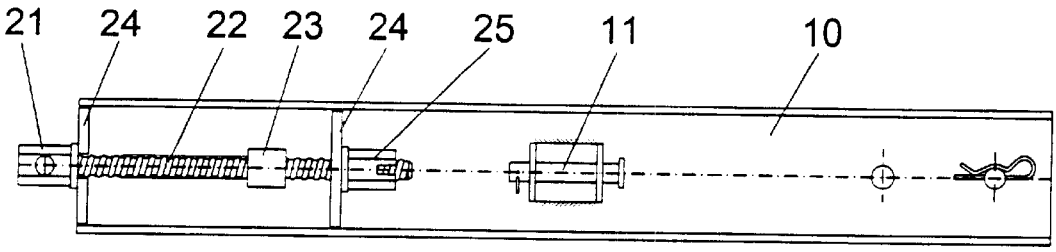
FIGS. 4, 5 and 6 show two longitudinal views and one end elevation view of the stiffener used in the formwork system that is the object of the invention.
Figure 5:
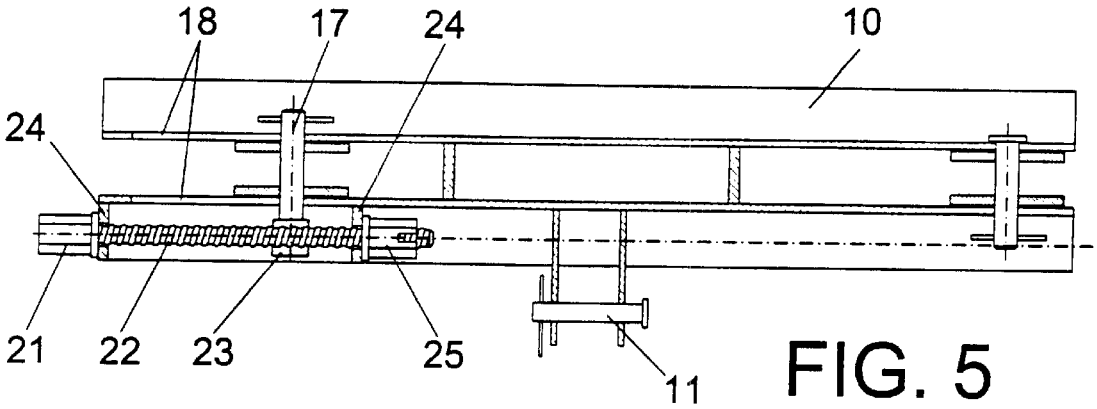
Figure 6:
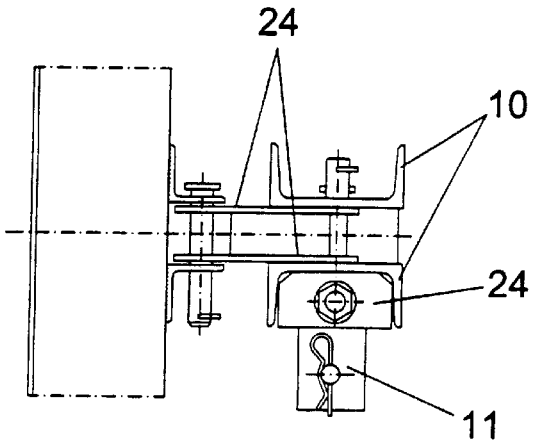

The panels also include pairs of stiffeners (10) comprised of two "UPN" profiles, as shown in FIGS. 4, 5 and 6, which stiffeners (10) are provided with an adjustable tensioning device and on their bottom with holds used to attach the corresponding stabilizers with which the formwork assembly is set and secured, which holds are labeled by the number (11).

As regards the stiffeners (10), four are mounted on each panel, two for each plate (2), with each pair joined by an intermediate tensioning device (12).

Thus, the main characteristic of the invention is that between said trapezoidal profiles (7) and stiffeners (10) are mounted intermediate elements or triangles (13), by which is transmitted the motion required to generate the curve related to each need, through which the loads die to the concrete pressure are transmitted.

The end triangles (13) are connected to the outermost trapezoidal profile (7) of that side, to the corresponding adjacent edge profile (7') and to the external end of the corresponding stiffener (10), while between the three intermediate trapezoidal profiles (7) are mounted two central triangles (13) joined to each other by one of their ends and also joined by the corresponding intermediate trapezoidal profile (7) by a pin or shaft (15), which pin is again present in the union of the corresponding end plates (13) to the edge profiles (7').

The other vertex of each triangle (13) opposite the aforementioned pin (15) has an elongated orifice (14) in which moves a pin (16) that allows the displacement between the triangle (13) and the trapezoidal profile (7). The third vertex of the central triangles (13) is joined by the corresponding pin (15) to the stiffeners (10) and to the ends of the central blocking tensioning device (12), while the third vertex of the end triangles (13) is joined to the stiffeners (10) by a pin (17) that moves in a slot (18) made for such purpose in said stiffeners (10).

Each triangular plate (13) is provided with a sheet (27) on which is mounted a threaded stud (28) with two nuts (29), joined at its other end to a shaft (20) provided for such purpose and mounted on a sheet joined to the corresponding trapezoidal profile (7), constituting a blocking means after the curvature is achieved, as will be explained below.

The stiffener (10) includes a tensioning device that can be actuated externally by means of a nut (21) joined to a spindle (22) which screws in a nut (23), from which emerges the shaft (17) that moves in the elongated slots (18) of the stiffeners (10), with the spindle (22) mounted, as well as on the nut (23) on a pair of plates (24) that are welded to one of the profiles that comprise the stiffener (10), all of this such that said stiffener-adjuster can turn in its housing and is prevented from moving axially by means of a nut (25) blocked by a winged pin.

Figure 7:
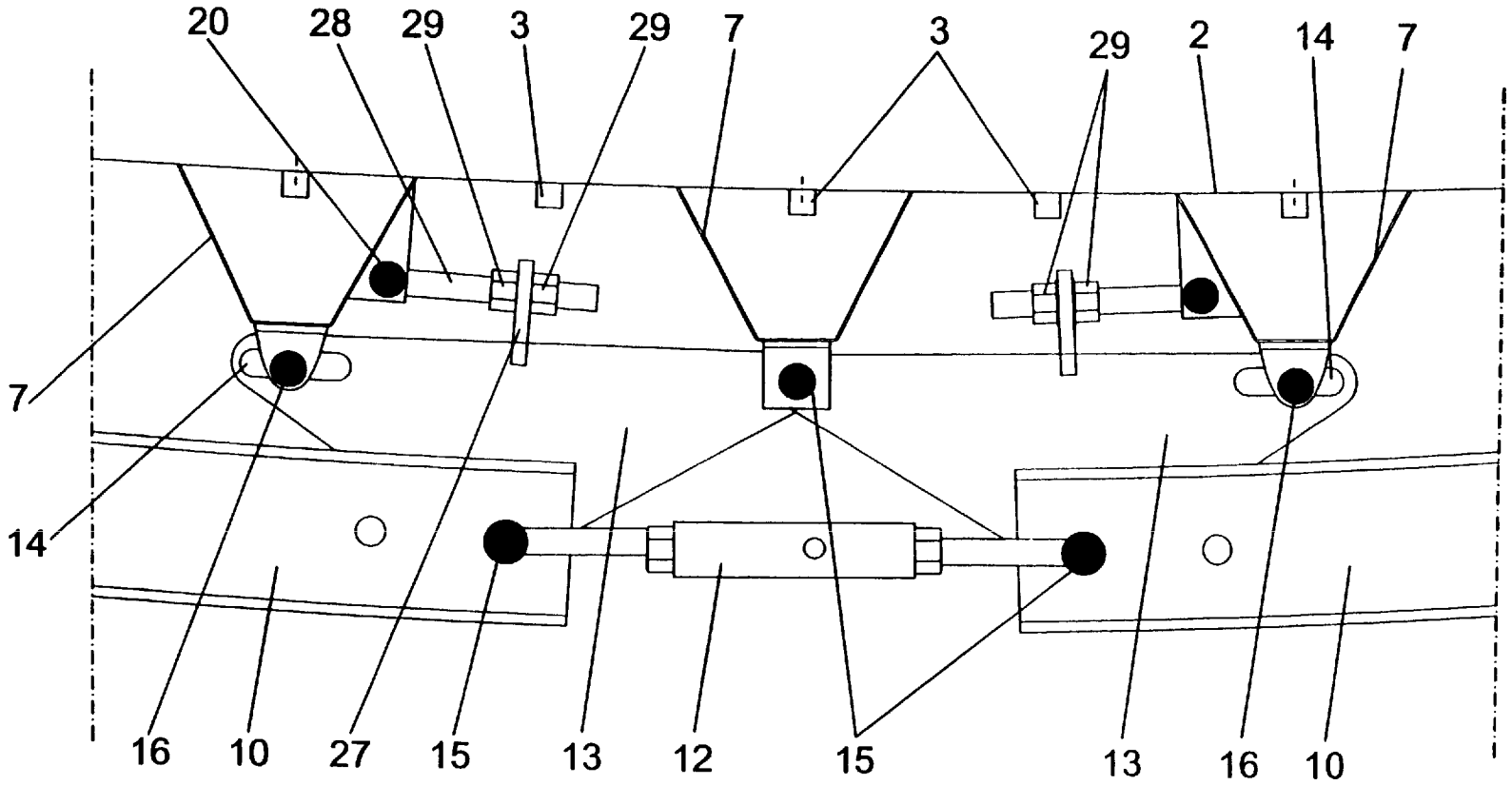
FIG. 7 shows, finally, an enlarged detail of the union of the stiffeners and the triangular plates, which are in turn joined to the trapezoidal profiles, as well as the blocking mechanism that maintains the formwork curvature after it is achieved.

In this manner, and as may be seen in FIGS. 1 and 7, when one of the end nuts (21) is actuated the spindle (22) is turned in one sense or the other, carrying the nut (23) and therefore the shaft (17) along the slot (18) of the stiffener (10), so that the corresponding triangle (13) is moved and as a result as it is connected to the trapezoidal profiles (7) of the sheet (2), the latter will be deformed or curved and with it the corresponding panel.

That is, by simply actuating the two end nuts (21) on a side of the panel the corresponding half of said panel is curved. To curve the other half, the corresponding end nuts (21) on the other side must be actuated.

Maintaining the resulting curvature of the formwork can be achieved by a blocking device that is comprised of the threaded stud (28) mounted between the trapezoidal profile (7), specifically between a sheet welded to it, and the sheet (27) welded to the triangular plate (13), with the tightening effected by the nuts (29) as shown in FIG. 7. Obviously during the curving phase these nuts (29) will be free, that is, mounted on the threaded stud (28) but not tightened, to allow the triangular plates (13) to move and thus to provide the panel curvature.

In addition, the central blocking tensioning device (12) is provided to ensure the curve at the central part of the panel.

Finally, the metal sheets (2) that form the formwork are joined to each other by crossbars (25) that pass through said sheets and through the stiffeners (10), and are secured by nuts or similar tightening means (26) as shown in FIG. 1.

What is claimed is:

1. Modular formwork system with varying curvature, of the type comprising a pair of metal sheets (2) that are complemented by a series of trapezoidal profiles (7) on which act tensioning devices that consist of a nut-spindle mechanism, provided on one end with stiffening elements (10), characterized in that five trapezoidal profiles (7) are welded to each formwork metal sheet (2), and on its ends are two edge profiles (7'), with the attachment of the stiffeners (10) to the trapezoidal profiles (7) and edge profiles (7') being effected by intermediate swiveling elements or triangles (13), such that each stiffener (10) is connected to two triangles (13), to one triangle, the central triangle, in a hinged manner and to other, the end triangle, by means of a actuation nut-spindle mechanism (22), with the central triangles (13) being joined to trapezoidal profiles (7) at their other two vertices by a hinged union (15) and a sliding union (16), while the end triangles (13) are joined to a trapezoidal profile (7) and to one of the edge profiles (7'), the union with the latter being hinged (15) while the trapezoidal profile (7) is provided with a sliding union (16), all of this such that when the nut (21) of the spindle (22) is actuated the triangles (13) swivel in one sense or the other, in turn pulling or pushing on two trapezoidal profiles (7) and edge profiles (7') and managing to curve the entire length of the metal sheet.

2. Modular formwork system with varying curvature, according to claim 1, characterized in that when two end nuts (21) joined to the spindles (22) of a side of the panel are acted upon, moving nuts (23) are also moved and thus shafts (17) are also moved to the corresponding triangle (13), which triangles in turn as they separate or approach each other pull or push on the trapezoidal profiles (7) and edge profiles (7') to curve half of the panel, while to attain the full curvature it suffices to actuate the two end nuts (21) of the other side of the panel, with these actuation means used both to curve the inner side of the formwork and to curve the outer side of the formwork.

3. Modular formwork system with varying curvature, according to claim 1, characterized in that each formwork panel includes five trapezoidal profiles (7), two edge profiles (7'), and two stiffeners (10) that are connected to the profiles (7) and (7') by four triangles (13), two of which are connected centrally to each other and to the ends of the stiffeners (10), and two end triangles connected to the ends of the stiffeners (10), to the outermost trapezoidal profiles (7) and to the edge profiles (7') provided on the sides, such that on the outer ends of the stiffeners (10) are provided the nut-spindle actuation mechanisms (22).

4. Modular formwork system with varying curvature, according to claim 1, characterized in that a double mechanism is provided to block the curvature obtained in a formwork panel, which mechanism is comprised of a threaded pin (28) that passes through a plate (27) joined to the triangle (13), with said threaded pin (28) complemented by two nuts (29) and being joined on its other end to a shaft (20) provided on the other plate that is joined to the corresponding trapezoidal profile (7), so that tightening these two nuts (29) results in blocking the mechanism and maintaining the panel curvature in the desired and obtained position, while the other blocking mechanism comprises a central tensioning device (12) that will be assembled after the full panel curvature is obtained by actuating the nut-spindle mechanisms (22).

5. Modular formwork system with varying curvature, according to claim 1, characterized in that each of the intermediate swiveling mechanisms or triangles (13) comprises a pair of triangular plates and is provided in one of its vertices with a slot (14) inside which moves the pin (16) that is joined to the trapezoidal profile (7).

6. Modular formwork system with varying curvature, according to claim 1, characterized in that the formwork sheets (2) of the formwork panel are provided on their upper and lower edges with centering shims (3) (3') for positioning and correct assembly of the modules and panels, as well as with ties-nuts (5) that ensure the vertical fixation of the panels.

7. Modular formwork system with varying curvature, according to claim 1, characterized in that in correspondence with the bottom edge the formwork sheets (2) have levelers (6) comprised of a spindle mounted on a nut, which spindle ends on its bottom with a support base to provide a correct setting of the sheet and thus of the panel, as well as its separation from the floor.

* * * * *